US009028026B2

(12) United States Patent
Byun et al.

(10) Patent No.: US 9,028,026 B2
(45) Date of Patent: May 12, 2015

(54) APPARATUS FOR PRINTING ON 3-DIMENSIONAL SURFACE USING ELECTROHYDRODYNAMIC FORCE

(71) Applicant: Enjet Co., Ltd., Suwon-si, Gyeonggi-do (KR)

(72) Inventors: Do-Young Byun, Seoul (KR); Vu Dat Nguyen, Suwon-si (KR)

(73) Assignee: Enjet Co. Ltd., Suwon-si Gyeonggi-do (KR)

( * ) Notice: Subject to any disclaimer, the term of this patent is extended or adjusted under 35 U.S.C. 154(b) by 0 days.

(21) Appl. No.: 13/898,091

(22) Filed: May 20, 2013

(65) Prior Publication Data

US 2013/0307892 A1 Nov. 21, 2013

(30) Foreign Application Priority Data

May 21, 2012 (KR) ..... 10-2012-0053734

(51) Int. Cl.

| | |
|---|---|
| ***B41J 29/38*** | (2006.01) |
| ***B41J 2/06*** | (2006.01) |
| ***B41J 2/045*** | (2006.01) |
| ***B41J 3/407*** | (2006.01) |

(52) U.S. Cl.

CPC ..... *B41J 2/04586* (2013.01); *B41J 3/4073* (2013.01)

(58) Field of Classification Search

CPC ..... B41J 3/4073; B41J 2/045; B41J 2/04586; B41J 2/095; B41J 2/41; B41J 2/415; B41J 2/4155

USPC ..... 347/9, 14, 5, 55, 57, 65

See application file for complete search history.

(56) References Cited

U.S. PATENT DOCUMENTS

| | | | | |
|---|---|---|---|---|
| 5,931,166 | A * | 8/1999 | Weber et al. | 132/73 |
| 2006/0051518 | A1 * | 3/2006 | Persson | 427/458 |
| 2007/0182773 | A1 * | 8/2007 | Kim et al. | 347/9 |
| 2008/0117248 | A1 * | 5/2008 | Uptergrove | 347/16 |
| 2011/0134195 | A1 * | 6/2011 | Kim et al. | 347/71 |
| 2012/0105528 | A1 * | 5/2012 | Alleyne et al. | 347/14 |

FOREIGN PATENT DOCUMENTS

| | | | |
|---|---|---|---|
| JP | 07-068833 | A | 3/1995 |
| KR | 10-0330945 | B1 | 4/2002 |
| WO | WO-2004-007203 | A | 1/2004 |
| WO | WO 2004007203 | A1 * | 1/2004 |

* cited by examiner

*Primary Examiner* — G. M.
*Assistant Examiner* — Scott A Richmond
(74) *Attorney, Agent, or Firm* — Saliwanchik, Lloyd & Eisenschenk

(57) ABSTRACT

Provided herein is an apparatus for printing on a 3-dimensional surface using electrohydrodynamic force, the apparatus having a stage where a print object is placed; a shape obtainer storing surface information of the print object; a nozzle receiving ink and discharging the received ink to a surface side of the print object; a power supply supplying power to the nozzle; and a controller receiving the surface information of the print object from the shape obtainer and controlling a movement of the nozzle or the stage. Thus, an apparatus for printing on a 3-dimensional surface using electrohydrodynamic force is provided, which is capable of performing a precision printing process on a 3-dimensional surface.

6 Claims, 5 Drawing Sheets

APPARATUS FOR PRINTING ON 3-DIMENSIONAL SURFACE USING ELECTROHYDRODYNAMIC FORCE

CROSS-REFERENCE TO RELATED APPLICATION

This application claims the benefit under 35 U.S.C. §119 of Korean Patent Application No. 10-2012-0053734, filed May 21, 2012, which is hereby incorporated by reference in its entirety.

BACKGROUND

1. Field of Invention

The following description relates to an apparatus for printing on a 3-dimensional surface using electrohydrodynamic force, and more particularly to an apparatus for printing on a 3-dimensional surface using electrohydrodynamic force capable of performing a process of printing a desired shape on a 3-dimensional surface.

2. Description of Related Art

In general, a liquid droplet jet apparatus for jetting fluid in a liquid droplet form was usually applied to ink jet printers, and recently it is being developed to applied to high-tech high value added fields such as display processes, printed circuit board processes, and DNA manufacturing chip processes etc.

In the conventional ink jet printer field, for ink jet apparatuses for jetting ink in a liquid droplet form, mostly the piezo driving method and thermal driving method have been mainly used, but these methods caused nozzle clogging and thermal problems, and were not suitable for large size printing, and had possibility of material degeneration.

Due to these problems, a liquid droplet jet apparatus applying power to opposing electrodes to generate electrohydrodynamic force, and then jetting conductive liquid droplet by the generated electric field is being developed and in wide use, recently.

However, even in a conventional ink jet printer and liquid droplet jet apparatus using electrohydrodynamic force method, there is still difficulty in printing on an curved 3-dimensional surface. In a conventional ink jet printer, the viscosity of the ink is limited to 30 cP, and thus such a conventional inkjet printer cannot be applied to a surface which is curved quite significantly, since liquid droplet would flow down. Furthermore, there are still difficulties in performing a precision printing process on a surface having a 3-dimensional shape and not a flat surface in the case of using electrohydrodynamic liquid droplet jet apparatus.

BRIEF SUMMARY

Therefore, the purpose of the present disclosure is to resolve the problems of prior art aforementioned by providing an apparatus for printing on a 3-dimensional surface using electrohydrodynamic force capable of performing a precision printing process on a 3-dimensional surface.

In one general aspect, there is provided an apparatus for printing on a 3-dimensional surface using electrohydrodynamic force, the apparatus comprising a stage where a print object is placed; a shape obtainer storing surface information of the print object; a nozzle receiving ink and discharging the received ink to a surface side of the print object; a power supply supplying power to the nozzle; and a controller receiving the surface information of the print object from the shape obtainer and controlling a movement of the nozzle or the stage.

The controller may comprise a path obtainer comparing a printing path with the surface information of the print object provided from the shape obtainer, and generating convey information of the nozzle or the stage; and a convey control module using the convey information provided from the path obtainer to control the movement of the nozzle or the stage.

The path obtainer may comprise an input module where the printing path is input; and an align module comparing the printing path provided from the input module with the surface information of the print object provided from the shape obtainer, and aligning the printing path.

The align module may generate jet information of ink liquid droplet being jet from the nozzle, and the controller may further comprise a jet module using the jet information provided from the align module to control the power supply.

The path obtainer may further comprise a convert module converting 2-dimensional printing path information input to the input module into 3-dimensional printing path information.

According to the present disclosure, an apparatus for printing on a 3-dimensional surface using electrohydrodynamic force capable of performing a precision printing process on a 3-dimensional surface is provided.

In addition, it is possible to obtain real time surface information on a print object, thereby reducing time spent on a printing process.

In addition, it is possible to convert 2-dimensional printing path information which is input, into 3-dimensional information, thereby improving the printing quality.

Other features and aspects may be apparent from the following detailed description, the drawings, and the claims.

Figure 1:
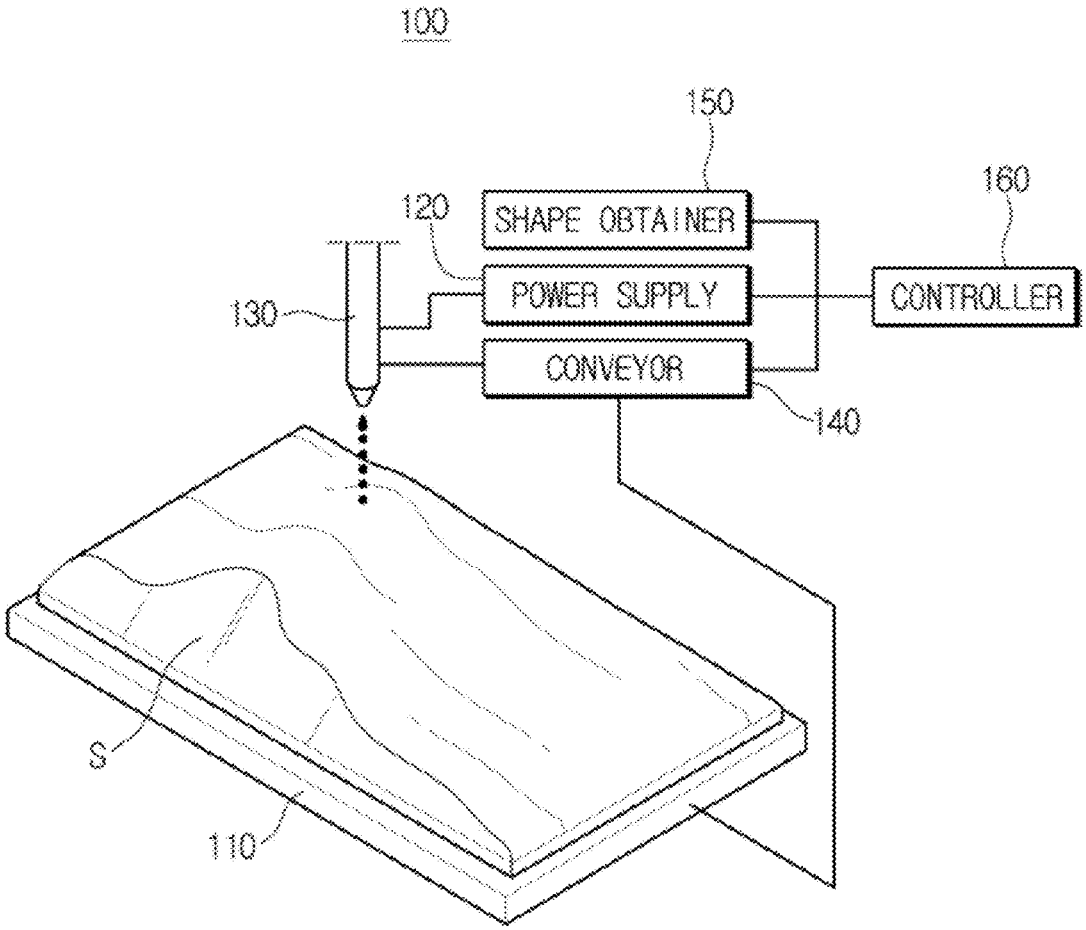
FIG. 1 is a perspective view of an apparatus for printing on a 3-dimensional surface using electrohydrodynamic force according to an exemplary embodiment of the present disclosure.

Throughout the drawings and the detailed description, unless otherwise described, the same drawing reference numerals will be understood to refer to the same elements, features, and structures. The relative size and depiction of these elements may be exaggerated for clarity, illustrating, and convenience.

DETAILED DESCRIPTION

The following detailed description is provided to assist the reader in gaining a comprehensive understanding of the methods, apparatuses, and/or systems described herein. Accordingly, various changes, modifications, and equivalents of the systems, apparatuses and/or methods described herein will be suggested to those of ordinary skill in the art. Also, descriptions of well-known functions and constructions may be omitted for increased clarity and conciseness.

An apparatus for printing on a 3-dimensional surface using electrohydrodynamic force 100 according to an exemplary embodiment of the present disclosure is an apparatus for performing a printing operation on a print object having a 3-dimensional surface, the apparatus including a stage 110, a power supply 120, a nozzle 130, a conveyor 140, and a shape obtainer 150.

Figure 2:
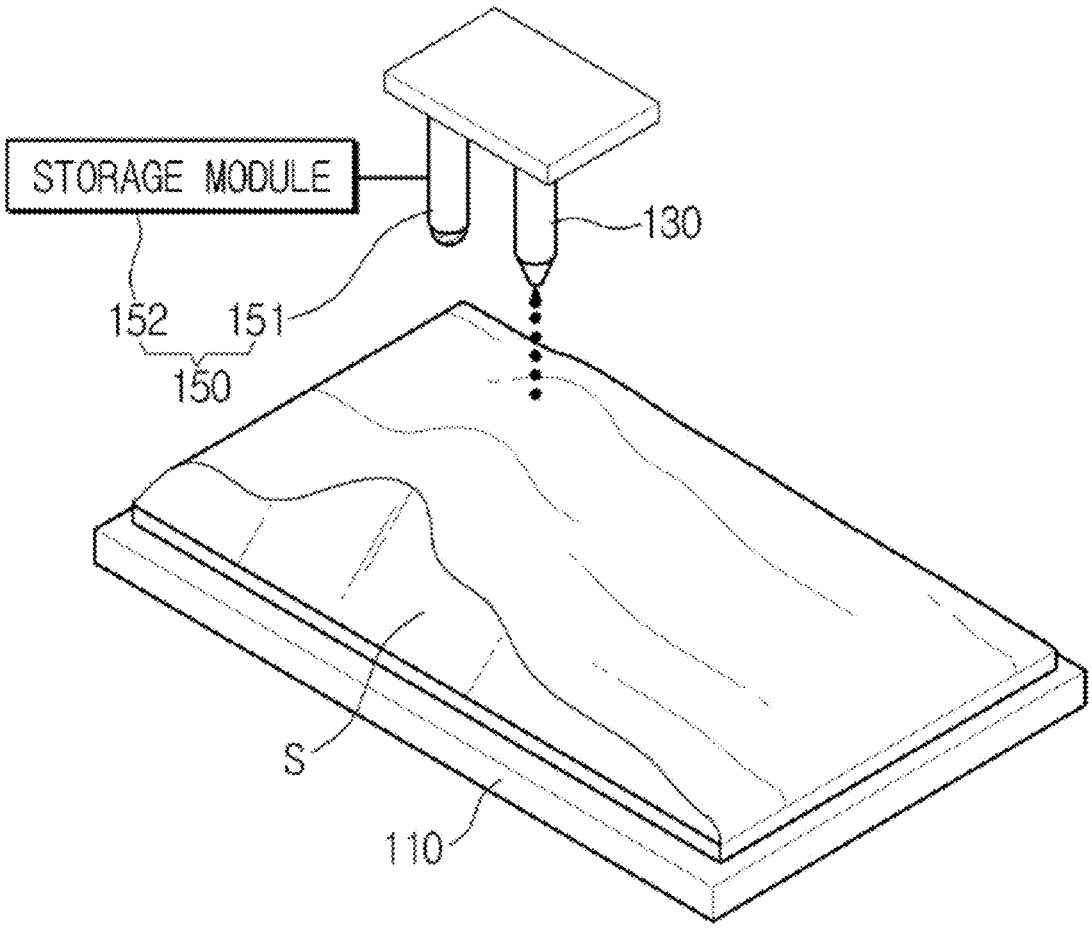
FIG. 2 is a view illustrating a shape obtainer of an apparatus for printing on a 3-dimensional surface using electrohydrodynamic force of FIG. 1.
Figure 3:
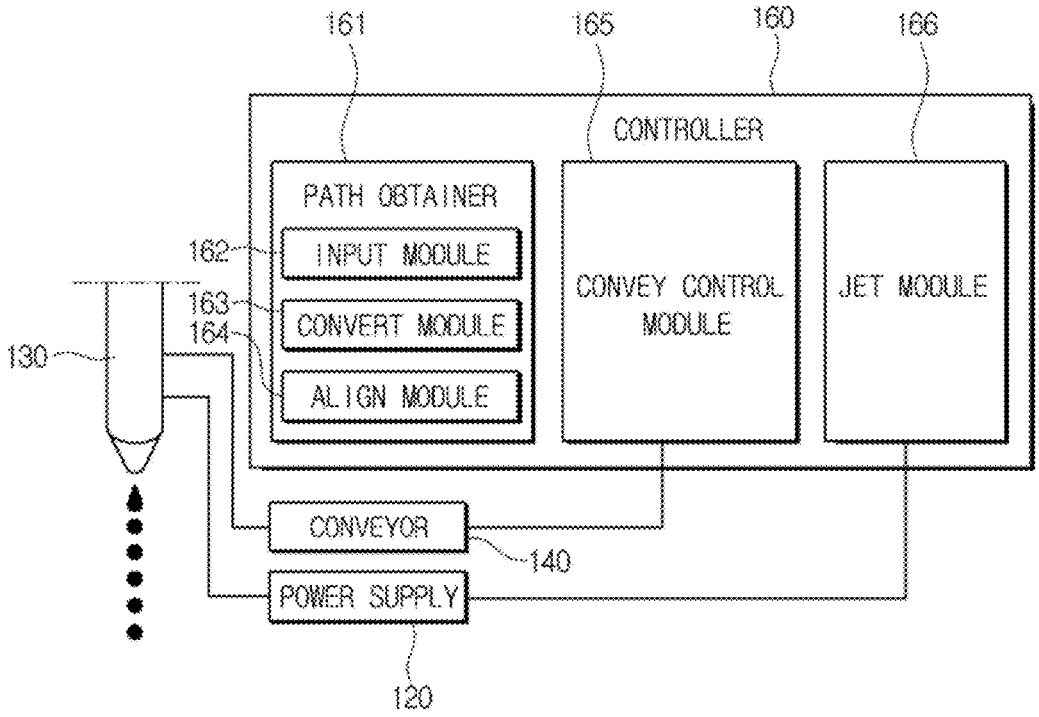
FIG. 3 is a view illustrating a controller of an apparatus for printing on a 3-dimensional surface using electrohydrodynamic force of FIG. 1.

FIG. 1 is a perspective view of an apparatus for printing on a 3-dimensional surface using electrohydrodynamic force according to an exemplary embodiment of the present disclosure, FIG. 2 is a view depicting a shape obtainer of an apparatus for printing on a 3-dimensional surface using electrohydrodynamic force of FIG. 1, and FIG. 3 is a view depicting a controller of an apparatus for printing on a 3-dimensional surface using electrohydrodynamic force of FIG. 1.

With reference to FIG. 1, the stage 110 is a member where a print object S is placed, and the stage 110 provided such that it is movable in 3 axis directions. In addition, the stage 110 is electrically grounded so as to generate an electric field between the stage 110 and the nozzle 130 to be explained hereinbelow.

The power supply 120 is a member for applying power to the nozzle 130 to be explained hereinbelow, thereby generating an electric field between the stage 110 where the print object S is arranged and the nozzle 130.

The nozzle 130 is a member for receiving ink and jetting the ink to the stage 110 side, thereby directly performing a printing process. The nozzle 130 is provided with an ink flow path inside it. In addition, on an inner wall surface of the nozzle where the ink flow path is formed, there may be provided an electrode (not illustrated) for receiving power from the power supply and generating an electric potential difference between the opposing stage.

Although in the present exemplary embodiment, an electric field is generated between the stage 110 and the nozzle 130 based on a structure of applying voltage to an electrode inside the nozzle 130 and electrically grounding the stage 110, such a structure is not limited thereto as long as it may generate an electric potential difference between the nozzle 130 and the stage 110.

The conveyor 140 is a member which is electrically connected to the controller 160 to be explained hereinbelow, and which is controlled by the controller 160, so as to move the nozzle 130 or the stage 110 in 3 axis directions.

With reference to FIG. 2, the shape obtainer 150 is for obtaining and storing shape information of a print object S surface. The shape obtainer 150 is connected to the controller 160 to be explained hereinbelow, and provides the shape information of the print object S surface to the controller 160. The shape obtainer 150 includes a sensing member 151 and a storage module 152.

The sensing member 151 is arranged adjacently to the nozzle 130, and measures and senses real time 3-dimensional shape information of the print object S surface at the same time as a printing process.

The storage module 152 is a module for storing 3-dimensional shape information of the print object S surface measured and sensed by the sensing member 152.

Meanwhile, although in the present exemplary embodiment, information of the print object S surface is measured and stored in real time at the same time as a printing operation is performed, in other exemplary embodiments, shape information of a print object S surface may be pre-input and stored in the storage module 152 before a printing processes starts.

With reference to FIG. 3, the controller 160 is for receiving real time 3-dimensional shape information of the print object S surface from the aforementioned shape obtainer 150 and for controlling a moving speed and a distance of the nozzle 130 or stage 110, and a jetting intensity of ink being jetted by the nozzle 130. The controller 160 includes a convey control module 165 and a jet module 166.

The path obtainer 161 is a member for obtaining a printing path of ink being jetted and printed by the nozzle 130. The path obtainer 161 includes an input module 162, convert module 163, and align module 164.

The input module 162 is a module for receiving and storing the information on the printing path of the ink being jetted and printed from the nozzle 130. Herein, in the input module 162, printing path information of 2-dimensional path information, 3-dimensional path information, or combined path information thereof may be stored.

The convert module 163 is a module for converting 2-dimensional printing path information into 3-dimensional printing path information when the printing path information of ink input in the input module 162 is 2-dimensional information, so as to enable comparison with the 3-dimensional shape information of the print object S surface and alignment of the printing path accordingly. That is, the convert module 163 is a member which is connected to the aforementioned input module 162, and which is selectively operated only when the input printing path information is 2-dimensional information, in order to convert the 2-dimensional printing path information into 3-dimensional printing path information.

The align module 164 aligns the pre-input or finally converted 3-dimensional printing path information on the 3-dimensional print object S surface information stored in real time in the storage module 152.

The convey control module 165 is a module using the 3-dimensional printing path information obtained from the path obtainer 161 to control the conveyor 140, thereby conveying the nozzle in the upper side or the stage 110 in the lower side.

The jet module 166 uses the 3-dimensional printing path information obtained from the path obtainer 161 to adjust an intensity of the electric field generated between the nozzle 130 and the stage 110, that is, a jetting intensity of the ink liquid droplet being jetted from the nozzle.

In the present exemplary embodiment, the jet module 163 adjusts voltage and current applied from the power supply 120 to the nozzle 130 in order to control the ink liquid droplet being jetted, but is not limited thereto.

Hereinbelow is explanation on an operation according to an exemplary embodiment of an aforementioned apparatus for printing on a 3-dimensional surface using electrohydrodynamic force.

Figure 4:
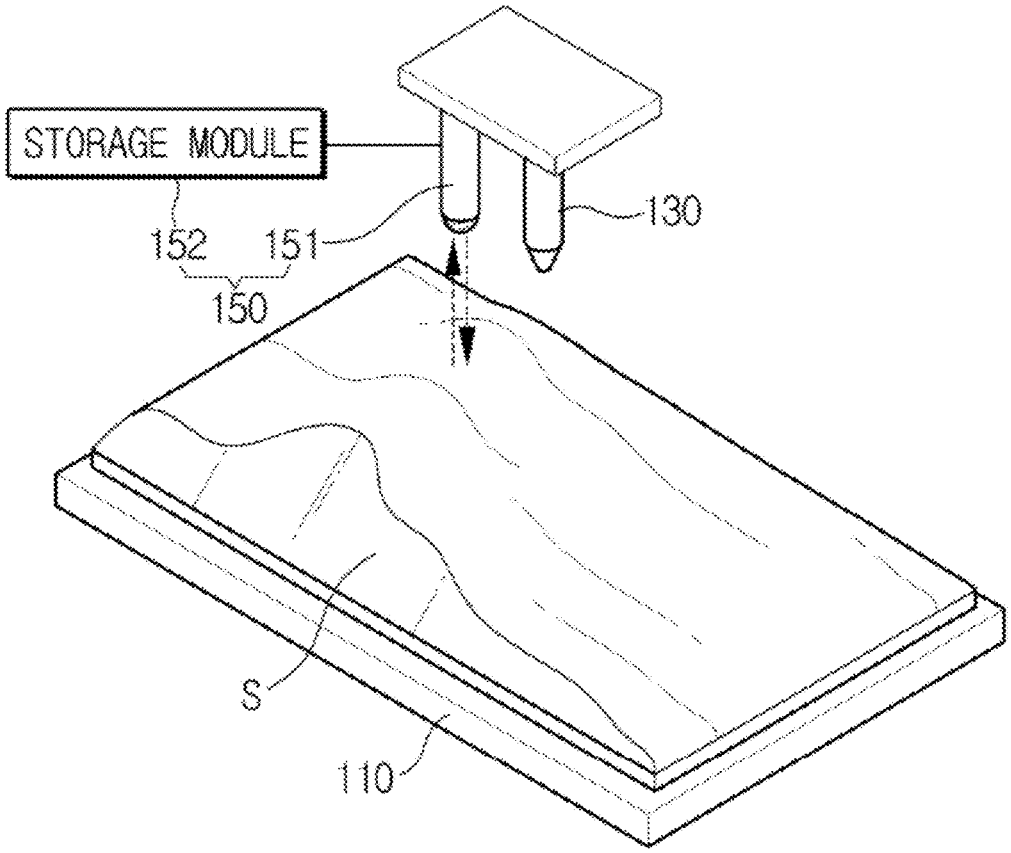
FIG. 4 is a view illustrating a principle of obtaining a shape of a print object surface using a shape obtainer of an apparatus for printing on a 3-dimensional surface using electrohydrodynamic force of FIG. 1.

FIG. 4 is a depicting of a principle of obtaining a shape of a print object surface using the shape obtainer of the apparatus for printing on a 3-dimensional surface using electrohydrodynamic force.

First of all, as illustrated in FIG. 4, the sensing member 151 arranged adjacent to the nozzle 130 measures a surface shape of a print object S placed on the stage 110, at the same time as the nozzle 130 is conveyed by the conveyor 140. Herein, the print object S surface information measured real time is stored through the storage module 152.

Figure 5:
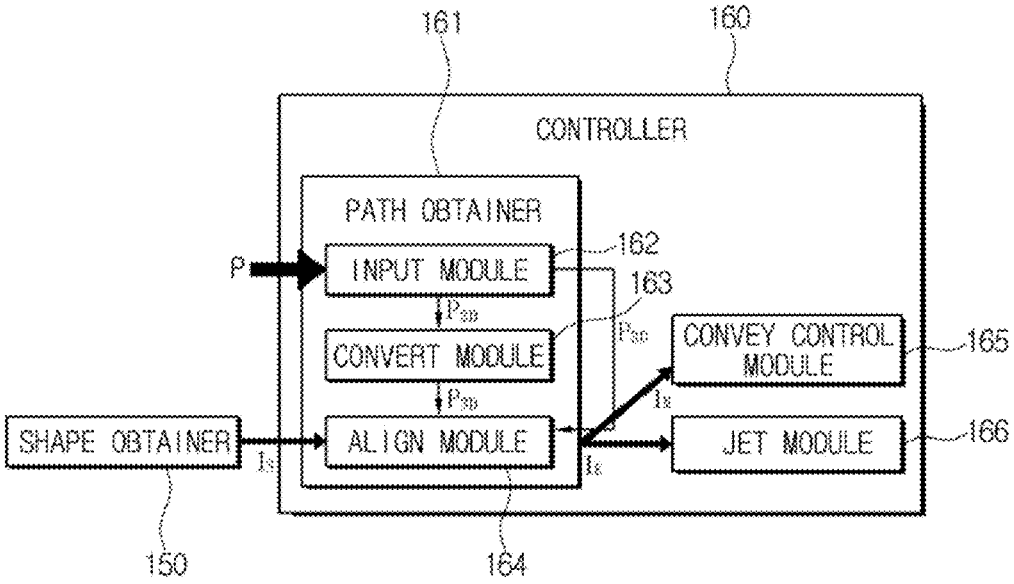
FIG. 5 is a view illustrating an operating principle of a controller of an apparatus for printing on a 3-dimensional surface using electrohydrodynamic force of FIG. 1.

FIG. 5 is a depicting of an operating principle of a controller of an apparatus for printing on a 3-dimensional surface using electrohydrodynamic force.

A method of obtaining printing path information through the path obtainer 161 at the same time as a real time shape measurement is explained hereinbelow with reference to FIG. 5.

First of all, a case of pre-storing a 3-dimensional printing path $P_{3D}$ in the input module 162 of the path obtainer 161 is explained hereinbelow. When a 3-dimensional printing path $P_{3D}$ is pre-input in the input module 162, the align module 164 compares the pre-stored 3-dimensional printing path $P_{3D}$ with a 3-dimensional print object S surface shape $I_s$ being stored real time in the storage module 152, and calculates a convey path for conveying the nozzle 130 or the stage 110 in each position, convey information $I_M$ including a distance between the nozzle 130 and the stage 110, and jet information $I_E$ including a size and speed of ink liquid droplet being jet from the nozzle 130.

However, in a case where 2-dimensional printing path $P_{3D}$ is stored in the input module 162 of the path obtainer 161, such printing path information $P_{3D}$ which is 2-dimensional information is not sent to the align module 24 directly, but passes the convert module 163 so that the format of the path information may be converted. That is, the convert module 163 receives the 2-dimensional printing path $P_{3D}$ from the input module 162 and converts it into a 3-dimensional printing path $P_{3D}$. Next, the align module 164 receives the converted 3-dimensional printing path $P_{3D}$ from the convert module 163 and processes it.

The convey information $I_M$ which includes the position and distance of the nozzle 130 or the stage 110 finally calculated by the align module 164 is sent real time to the convey control module 162, and then the convey control module 162 controls the speed and distance of the nozzle 130 or stage 110 in real time.

In addition, the jet information $I_E$ of the ink liquid droplet calculated by the align module 164 is sent to the jet module 163, and then the jet module 163 controls the power applier, thereby controlling the voltage or current supplied to the electrode inside the nozzle.

In general, the principle of the liquid droplet jet apparatus using electrohydrodynamic force is to use the electric field distribution between the nozzle 130 and the stage 110 to form liquid droplet or continuous jetting from a balance relationship between the electrohydrodynamic force applied to the liquid surface formed on the nozzle, thereby performing a patterning.

As aforementioned, the illustrated present exemplary embodiment uses the principle of drawing the liquid surface using electrohydrodynamic force to jet liquid droplet, and may thus perform a patterning even in a case of high-viscosity ink up to 50000 Cp.

In addition, the present exemplary embodiment has an advantage of performing a micro or nanoscale patterning, and thus is capable of performing a patterning even on a curved 3-dimensional surface.

Especially, in distribution of an electric field which may form a certain electrohydrodynamic force, the information on the distance between the nozzle 130 and the stage 110 is a very important element, and since it is possible to performing jetting while maintaining a certain distance between the stage 110 and the nozzle 130 using the aforementioned operating principle according to the present exemplary embodiment, it is possible to perform a 3-dimensional surface.

That is, according to the present disclosure, it is possible to print with precision a desired pattern on a print object having a 3-dimensional surface, and produce high-quality print material.

A number of examples have been described above. Nevertheless, it will be understood that various modifications may be made. For example, suitable results may be achieved if the described techniques are performed in a different order and/or if components in a described system, architecture, device, or circuit are combined in a different manner and/or replaced or supplemented by other components or their equivalents. Accordingly, other implementations are within the scope of the following claims.

DESCRIPTION OF REFERENCE NUMERALS

100: APPARATUS FOR PRINTING ON 3-DIMENSIONAL SURFACE USING ELECTROHYDRODYNAMIC FORCE ACCORDING TO PRESENT DISCLOSURE
110: STAGE
120: POWER SUPPLY
130: NOZZLE
140: CONVEYOR
150: SHAPE OBTAINER
160: CONTROLLER

What is claimed is:

1. An apparatus for printing on a 3-dimensional surface using electrohydrodynamic force, the apparatus comprising:

a stage on which a print object having a three-dimensional surface is disposed;

a nozzle receiving ink and discharging the received ink to a surface of the print object by an electric field;

a power supply supplying power to the nozzle so as to form an electric field between the nozzle and the stage;

a shape obtainer including a sensing member measuring 3-dimensional shape information of the print object and a storage module storing the 3-dimensional shape information measured by the sensing member; and a controller receiving the information regarding the surface of the print object from the shape obtainer and controlling at least one of a moving speed of the nozzle or the stage, a distance between the nozzle and the stage, and an intensity of the electric field;

wherein the controller compares information regarding a printing path of the ink jetted from the nozzle with the 3-dimensional shape information stored in the shape obtainer, converts the information regarding the printing path into 3-dimensional printing path information when the information regarding the printing path is two-dimensional information, and aligns the 3-dimensional printing path information on the 3-dimensional shape information, while aligning the information regarding the printing path on the 3-dimensional shape information when the information regarding the printing path is 3-dimensional information to thereby calculate convey information and jet information, and then, controls at least one of the moving speed of the nozzle or the stage, the distance between the nozzle and the stage, and the power supply so as to maintain a constant intensity level of the electric field formed between the nozzle and the stage.

2. The apparatus according to claim 1, wherein the controller comprises:

a path obtainer comparing the printing path with the surface information of the print object provided from the shape obtainer, and generating the convey information of the nozzle or the stage; and a convey control module using the convey information provided from the path obtainer to control the movement of the nozzle or the stage.

3. The apparatus according to claim 2,
wherein the path obtainer comprises:
an input module where the printing path is input; and
an align module comparing the printing path provided from the input module with the surface information of the print object provided from the shape obtainer, and aligning the printing path.

4. The apparatus according to claim 3,
wherein the align module generates jet information of ink liquid droplet being jet from the nozzle, and
wherein the controller further comprises a jet module using the jet information provided from the align module to control the power supply.

5. The apparatus according to claim 3,
wherein the path obtainer further comprises a convert module converting 2-dimensional printing path information input to the input module into 3-dimensional printing path information.

6. The apparatus according to claim 4,
wherein the path obtainer further comprises a convert module converting 2-dimensional path information input to the input module into 3-dimensional print path information.

* * * * *